US008903106B2

(12) United States Patent
Meyer et al.

(10) Patent No.: US 8,903,106 B2
(45) Date of Patent: Dec. 2, 2014

(54) AUGMENTED ELLIPTICAL MICROPHONE ARRAY

(75) Inventors: Jens M. Meyer, Vermont, NY (US); Gary W. Elko, Summit, NJ (US)

(73) Assignee: MH Acoustics LLC, Summit, NJ (US)

( * ) Notice: Subject to any disclaimer, the term of this patent is extended or adjusted under 35 U.S.C. 154(b) by 621 days.

(21) Appl. No.: 12/595,082

(22) PCT Filed: Jul. 9, 2008

(86) PCT No.: PCT/US2008/069483

§ 371 (c)(1), (2), (4) Date: Oct. 8, 2009

(87) PCT Pub. No.: WO2009/009568

PCT Pub. Date: Jan. 15, 2009

(65) Prior Publication Data

US 2010/0202628 A1 Aug. 12, 2010

Related U.S. Application Data

(60) Provisional application No. 60/948,573, filed on Jul. 9, 2007.

(51) Int. Cl.
*H04R 3/00* (2006.01)
*H04R 1/40* (2006.01)

(52) U.S. Cl.
CPC ..... *H04R 1/406* (2013.01); *H04R 3/005* (2013.01); *H04R 2201/401* (2013.01); *H04R 2410/01* (2013.01); *H04R 2430/20* (2013.01); *H04R 2201/405* (2013.01)
USPC ..... 381/92

(58) Field of Classification Search
CPC ... H04R 3/005; H04R 1/406; H04R 2201/401
USPC ..... 381/92, 91, 122, 94.1, 111–115, 381/356–358, 362, 366
See application file for complete search history.

(56) References Cited

U.S. PATENT DOCUMENTS 4,119,799 A 10/1978 Merlino
4,392,548 A 7/1983 Bailey
(Continued)

FOREIGN PATENT DOCUMENTS

WO WO03037034 A1 5/2003

OTHER PUBLICATIONS

Henderson, P., "Directional Room Acoustics Measurement Using Large-Scale Microphone Arrays", AES 115th Convention Paper 5899, New York, New York, USA, Oct. 10-13, 2003, pp. 1-9.*

(Continued)

*Primary Examiner* — Lun-See Lao
(74) *Attorney, Agent, or Firm* — Mendelsohn, Drucker & Dunleavy, P.C.; Steve Mendelsohn

(57) ABSTRACT

In one embodiment, an audio system has a microphone array and a signal processing subsystem that processes audio signals generated by the microphone array to produce an output beampattern. The microphone array has (i) a plurality microphones arranged in a circular portion and (ii) a center microphone. The signal processing subsystem has (1) a decomposer that spatially decomposes the microphone audio signals to generate a plurality of eigenbeams and (2) a beamformer that generates the output beampattern as a weighted sum of the eigenbeams. By adding the center microphone, the audio system is able to provide some degree of control over the beamforming in the vertical direction as well as provide reduction of modal aliasin.

13 Claims, 8 Drawing Sheets

(56) References Cited

U.S. PATENT DOCUMENTS

| | | | | |
|---|---|---|---|---|
| 5,778,083 | A * | 7/1998 | Godfrey | 381/92 |
| 6,236,730 | B1 | 5/2001 | Cowieson et al. | |
| 6,980,661 | B2 * | 12/2005 | Godfrey et al. | 381/26 |
| 2002/0009203 | A1 * | 1/2002 | Erten | 381/92 |
| 2005/0123149 | A1 * | 6/2005 | Elko et al. | 381/92 |

OTHER PUBLICATIONS

PCT International Search Report, Jan. 29, 2009, for PCT/US2008/069483 (12 pages).

European Search Report; Mailed Apr. 10, 2013 for corresponding EP Application No. 08772473.8.

Meyer, J., "Beamforming for a Circular Microphone Array Mounted on Spherically Shaped Objects", The Journal of the Acoustical Society of America, American Institute of Physics for the Acoustical Society of America, New York, NY, USA, vol. 109, No. 1, Jan. 1, 2001, pp. 185-193.

Guillaume, M., et al., "Sound Field Analysis with a Two-Dimensional Microphone Array", International Conference on Acoustics, Speech and Signal Processing, Toulouse, France, May 14-19, 2006, Piscataway, NJ, USA, IEEE, May 14, 2006, pp. V-321-V-324.

* cited by examiner

AUGMENTED ELLIPTICAL MICROPHONE ARRAY

CROSS-REFERENCE TO RELATED APPLICATIONS

This application claims the benefit of the filing date of U.S. provisional application No. 60/948,573, filed on Jul. 9, 2007, the teachings of which are incorporated herein by reference. The subject matter of this application is related to the subject matter of U.S. patent application Ser. No. 10/500,938, filed on Jul. 8, 2004, the teachings of which are incorporated herein by reference in its entirety.

BACKGROUND OF THE INVENTION

1. Field of the Invention

The present invention relates to audio signal processing, and, in particular, to microphone arrays used for modal beampattern control.

2. Description of the Related Art

With the proliferation of inexpensive digital signal processors and high-quality audio codecs, microphone arrays and associated signal processing algorithms are becoming more attractive as a solution to improve audio communication quality. For room audio conferencing, one attractive microphone array would be a circular array, which allows the beam to be steered to any angle in the horizontal plane around the array.

Circular microphone arrays are an attractive solution for audio pickup of desired sources that are located in the horizontal plane of the array. Typically, circular microphone array beamforming solutions either apply "conventional" delay or filter-sum beamforming techniques or use a cylindrical spatial harmonic decomposition approach. See, e.g., D. E. N. Davies, *Circular Arrays*, in Handbook of Antenna Design, Vol. 2, Chapter 12, London, Peregrinus (1983), the teachings of which are incorporated herein by reference in its entirety. In both cases, however, one is not able to control the beampattern in the vertical plane (out of the plane of the array). In fact, the vertical beampattern response can actually exceed the in-plane response of the circular array due to modal aliasing of vertical modes that are not controllable with a standard circular array.

SUMMARY OF THE INVENTION

In one embodiment of the present invention, a single microphone is added at the center of a circular microphone array. By using an additional central microphone, it is possible to gain control over the vertical direction beampattern response and therefore avoid the undesired effect of increasing sensitivity in the vertical direction as the frequency increases.

In one embodiment, the present invention is an audio system comprising a microphone array. The microphone array comprises (i) a first elliptical radial portion comprising a plurality of microphones and (ii) a second elliptical radial portion comprising one or more microphones and concentrically located within the first elliptical radial portion.

In another embodiment, the present invention is a signal processing subsystem for processing audio signals generated by a microphone array comprising (1) a first elliptical radial portion comprising a plurality of microphones and (2) a second elliptical radial portion comprising one or more microphones and concentrically located within the first elliptical radial portion. The signal processing subsystem comprises (i) a decomposer adapted to spatially decompose the audio signals generated by the microphone array into a plurality of eigenbeam outputs and (ii) a beamformer adapted to combine the plurality of eigenbeam outputs to generate one or more output beampatterns.

In yet another embodiment, the present invention is a method that comprises the step of receiving audio signals generated by a microphone array comprising (1) a first elliptical radial portion comprising a plurality of microphones and (2) a second elliptical radial portion comprising one or more microphones and concentrically located within the first elliptical radial portion. The audio signals generated by the microphone array are spatially decomposed into a plurality of eigenbeam output s and the plurality of eigenbeam output s are combined to generate one or more output beampatterns.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

Harmonic Decomposition Beamforming for Circular Arrays

Figure 1:
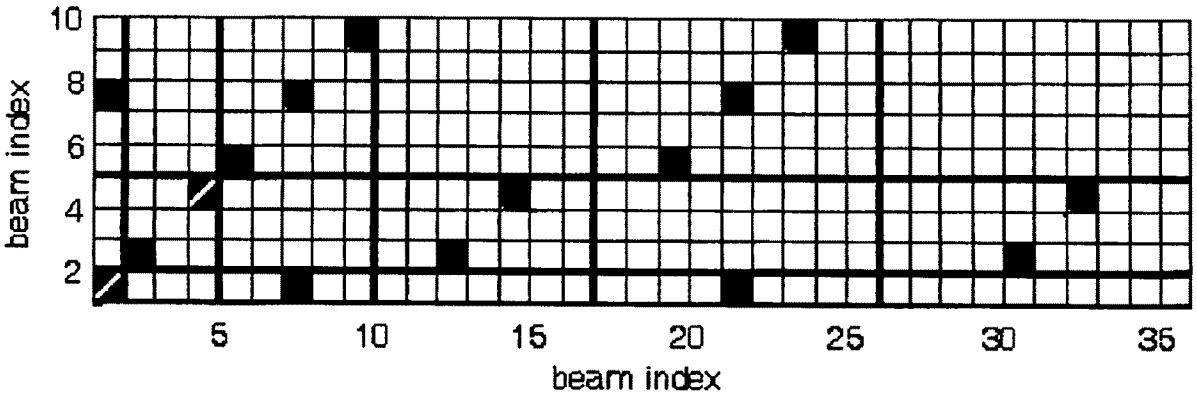
FIG. 1 shows a two-dimensional graphical representation of mode strengths for fundamental and aliased modes for a continuous circular array.

Beamforming based on a spatial harmonic decomposition of the sound-field has many appealing characteristics, some of which are steering with relatively simple computations, beampattern design based on an orthonormal series expansion, and the independent control of steering and beamforming. See, e.g., J. Meyer and G. W. Elko, "Spherical Microphone Arrays for 3D sound recording," Chapter 3 (pp. 67-90) in *Audio Signal Processing for Next Generation Multimedia Communication Systems*, Editors: Yiteng (Arden) Huang and Jacob Benesty, Kluwer Academic Publishers, Boston, (2004) (referred to herein as "Meyer and Elko"), and H. Teutsch and W. Kellermann, "Acoustic source detection and localization based on wavefield decomposition using circular microphone arrays," J. Acoust. Soc. Am. 120 (2006), 2724-2736 (referred to herein as "Teutsch and Kellermann"), the teachings of both of which are incorporated herein by reference in their entireties.

For a circular array, the natural coordinate system is cylindrical. However, since the three-dimensional beampattern of a microphone array, which by definition covers the sensitivity of the array in all directions, is of main interest, the spherical coordinate system is used instead. Using a spherical coordinate system, instead of a cylindrical coordinate system, also provides better insight into the impact of undesired modal aliasing to the vertical response of circular arrays and ways to deal with the problem.

Spherical harmonics $Y_n^m(\theta,\phi)$ are functions in the spherical angles $[\theta,\phi]$ and are defined according to Equation (1) as follows:

$$Y_n^m(\vartheta, \varphi) \equiv \sqrt{\frac{(2n+1)}{4\pi}\frac{(n-m)!}{(n+m)!}}\, P_n^m(\cos\vartheta)e^{im\varphi} \tag{1}$$

where $P_n^m$ represents the associated Legendre function of order n and degree m, $\theta$ is the elevation angle, and $\phi$ is the azimuth angle. See, e.g., E. G. Williams, *Fourier Acoustics*, Academic Press, San Diego (1999), the teachings of which are incorporated herein by reference in its entirety. The acoustic pressure $p(a, \theta, \phi, \theta_s, \phi_s)$ at a point on a (virtual) spherical surface of radius a due to a plane wave impinging from direction $[\theta,\phi]$ can be written in spherical coordinates according to Equation (2) as follows:

$$p(ka, \vartheta, \varphi, \vartheta_s, \varphi_s) = 4\pi\sum_{n=0}^{\infty} i^n j_n(ka)\sum_{m=-n}^{n} Y_n^m(\vartheta, \varphi)Y_n^{m*}(\vartheta_s, \varphi_s) \tag{2}$$

where $j_n$ represents the spherical Bessel function of order n, * indicates complex conjugate, and k is the wavenumber ($k=2\pi/\lambda$), where $\lambda$ is the wavelength of the acoustic wave. Note that the product ka is a dimensionless argument that explicitly shows the integrated scaling relationship between the acoustic frequency and radial dimension.

Using Equation (2), one can write the output ($y_m'(ka, \theta, \phi)$) of a continuous circular array lying in the horizontal plane with a sensitivity describing a complex exponential angular function with angular spatial frequency m' according to Equation (3) as follows:

$$\begin{aligned} y_{m'}(ka, \vartheta, \varphi) &= \frac{1}{2\pi}\int_0^{2\pi} 4\pi\sum_{n=0}^{\infty} i^n j_n(ka)\sum_{m=-n}^{n} Y_n^m(\vartheta, \varphi)Y_n^{m*} \\ &\quad (\pi/2, \varphi_s)e^{im'\varphi_s}d\varphi_s \\ &= 4\pi\sum_{n=m'}^{\infty} i^n j_n(ka)Y_n^{m'}(\pi/2, 0)Y_n^{m'}(\vartheta, \varphi) \\ &= 4\pi e^{im'\varphi}\sum_{n=m'}^{\infty} i^n j_n(ka)Y_n^{m'}(\pi/2, 0) \\ &\quad \sqrt{\frac{(2n+1)(n-m')!}{4\pi(n+m')!}}\, P_n^{m'}(\cos\vartheta) \end{aligned} \tag{3}$$

Equation (3) is a powerful result in terms of beamforming. It shows that the output $y_{m'}$ of the circular array exhibits a farfield directivity $e^{im'\varphi}$ in the horizontal plane identical to the array sensitivity. Therefore, by combining outputs with different angular spatial frequencies m', one can use standard Fourier Analysis to design an unsteered beampattern $d(\phi)$ in the horizontal plane (as long as the designed beampattern fulfills certain mathematical constraints such as absolutely integrable (i.e., where the integral of the magnitude of the integrand is finite)), according to Equation (4) as follows:

$$d(\varphi) = \sum_{m'=-N}^{N} a_{m'}c_{m'}(ka)y_{m'} \tag{4}$$

where $a_{m'}$ is a weighting for mode m', $c_{m'}$ is a frequency-response compensation coefficient to unify the responses of different modes, and $y_{m'}$ is the angular eigenbeam output formed by the continuous weighting of the circular array for angular harmonic m'. Frequency-response compensation is employed, since each mode has a different frequency response, as can be seen from the last line in Equation(3). N determines the maximum spatial harmonic frequency of the pattern. Once N is determined, there are 2N+1 modes that contribute to the overall pattern. Note that, depending on the pattern, some of the coefficients $a_{m'}$ might be zero; in which case, this mode m' will not contribute to the output beampattern. In practical realizations, the circular array is sampled at discrete locations, which allows flexibility in extracting the multiple individual modes. By discretely sampling the acoustic array, a spatial decomposer can provide simultaneous extraction of the multiple spatial harmonics.

As with the spherical eigenbeam solution described by Meyer and Elko, the actual selection of the number and positions of the discrete microphone elements on a circular array depends on the desired upper frequency limit and allowable undesired spatial aliasing from the discrete array. A natural spacing of the microphones on a circular array would be to place them at equal angular distances from one another, where the angle between the elements relative to the center position would be 360/S degrees, where S is the number of microphone elements in the array. However, one could more generally place the elements non-uniformly in angular distribution. A non-uniformly sampled circular array would enable more-general configurations of the array so that one would have more flexibility in the array layout. It should be noted that spatial aliasing due to discrete sampling of the acoustic field is a function of the array geometry.

The minimum number of microphone elements required for an array with maximum angular spatial frequency N is 2N+1. Thus, for N=2, the minimum number of elements is five. One can oversample the discrete array by using more microphones in the array. Oversampling of a discrete array by adding more microphones, while maintaining the same array order, reduces spatial aliasing. As described by Meyer and Elko, spatial aliasing can become severe when the element spacing becomes larger than ½ of the acoustic wavelength. If the array steering is limited in angle, a non-uniform spacing of microphone elements could be used to reduce undesired spatial aliasing relative to a uniformly spaced circular array.

In the case of S equally spaced sensors in the array, the sensor weights w define the sensitivity of the continuous aperture at the sampled location $\phi_s$, according to Equation (5) as follows:

$$w_{s,m'} = e^{im'\phi_s} \tag{5}$$

Using these weights, the result for the array output $\hat{y}_{m'}$ is given by the following Equation (6), which is a discrete-array approximation to Equation (3):

$$\hat{y}_{m'}(ka, \vartheta, \varphi) = \frac{1}{S}4\pi\sum_{s=0}^{S-1}\sum_{n=0}^{\infty} i^n j_n(ka)\sum_{m=-n}^{n} Y_n^m(\vartheta, \varphi)Y_n^{m*}(\pi/2, \varphi_s)w_{s,m'} = \frac{1}{S}\sum_{s=0}^{S-1} p_s w_{s,m'} \quad (6)$$

where $p_s$ is the measured acoustic pressure by the array microphone at position S. Note that the spatial aliasing due to the sampling of the continuous aperture is assumed to be neglectable in the operating range of the array and is therefore not included in Equation (6). However it should be noted that Equation(6) does include modal aliasing (aliasing due to sensitivity of the array to spherical spatial modes that cannot be distinctly separated by a 2D circular array geometry) in the array output. As will be shown later, one effective way to deal with vertical out-of-plane modes is to augment the array with additional, smaller circular arrays (which include the case of a single microphone in the center of the array). Thus, one decomposes the soundfield using Equation (6) and then augments this solution with either a single central microphone or outputs from concentric circular arrays. The additional inputs can be used to allow access to the detrimental vertical modes that can significantly deteriorate the circular beamformer directional performance in the vertical plane.

Since the beampattem design is based on a series of complex exponentials, an efficient steering method can be realized as stated in Equation (7) as follows:

$$d(\varphi - \varphi_0) = \sum_{m'=-N}^{N} a_{m'} c_{m'}(ka)\hat{y}_{m'} e^{-im'\varphi_0} \quad (7)$$

where $\phi_0$ is the look direction and $\hat{y}_{m'}$ is the m' angular harmonic eigenbeam estimated by the discrete array of S sensors. Steering of the beampattem is accomplished by multiplying each angular spatial harmonic by a complex exponential of the corresponding spatial frequency. Note that with the simple complex weighting as shown above, steering is accomplished only in the horizontal plane. Also, note that this equation contains the aliased vertical spherical harmonic modes. As previously mentioned, these spatially aliased vertical modes are separated by augmenting the circular array of S elements by either a single element in the center of the array or by using additional concentric arrays, or both.

In addition, one can choose other two-dimensional array topologies such as oval arrays instead of circular arrays and/or use oblate or prolate spheroidal functions or other suitable orthonormal basis functions for the underlying eigenbeam expansion instead of spherical or cylindrical harmonics.

Another important result from the last line in Equation (3) is the θ dependency of the output $y_{m'}$. It can be seen that this dependency is determined by an infinite sum of Legendre functions with a frequency dependency described by spherical Bessel functions. This result represents a significant disadvantage since it shows that there is no control over the directivity pattern outside the horizontal plane. As already mentioned, this loss of vertical control is due to modal aliasing which will become clear later. The sensitivity from directions outside the horizontal plane increases with frequency and eventually will become larger than the sensitivity in the main look direction within the horizontal plane.

A key idea put forward here is to modify the circular array by adding sensors to the circular array (e.g., a single sensor at the center of the circular array and/or one or more other concentric circular arrays of different radii) to obtain control over, not only the pattern in the horizontal plane (based on the complex exponential with angular spatial frequency m'), but also the spatial response in vertical directions. By adding more sensors to the array, and appropriately processing these additional sensors, one can gain access to the spherical harmonics of order n and degree m (compare Equation (3), second line). By defining the spherical harmonics as the target modes, the undesired loss of beampattern control in the vertical direction can be seen as a result of modal aliasing. Note that, unlike the previous discussion on spatial aliasing, this modal aliasing is not a result of discrete sampling of the array, but is also present in continuous arrays. Augmenting the circular array by judicious positioning of auxiliary sensors, allows one to now separate out the previously aliased vertical spherical harmonic modes. By having access to these vertical spherical modes, one can now use these modes to obtain control of the circular array beampattern in the vertical direction. This modal aliasing is analysed in more detail later and a solution to overcome it is presented.

Analyzing the Modal Aliasing of a Circular Array

From Equation (3), it can be seen that the aliasing of a specific mode depends on' a constant factor $Y_n^{m'}(\pi/2,0)$ and the frequency-dependent response $j_n^{(ka)}$. The constant modal aliasing factor is depicted in FIG. 1. For the two-dimensional plot, the order n and degree m of a specific mode is translated into a "beam index" of n(n+1)+m+1 to ease the visualization of the mode strengths for the fundamental desired eigenbeams as well as higher-order aliased eigenbeams. The desired eigenmode is represented on the vertical (y) axis, while the horizontal (x) axis represents the contributing sound-field components as relative levels. This means that, for example, the patch at position (1,1) in FIG. 1 shows the contribution of mode n=0, m=0 to the desired eigenbeam n=0, m=0 with a normalized level of 0 dB. The patch at position (7,1) in FIG. 1 shows the contribution of mode n=2, m=0 to the desired eigenbeam n=0, m=0. Here, the relative eigenbeam level is given by Equation (8) as follows:

$$20\log_{10}\left(\frac{Y_2^0(\pi/2, 0)}{Y_0^0(\pi/2, 0)}\right) = 1 \text{ dB} \quad (8)$$

Other patches in FIG. 1 are computed accordingly. Note that all the relative modal aliasing levels are in the range of 1-2 dB. In general, the patches on the diagonal x=y represent the desired components, while all other patches represent modal aliasing terms.

Another important aspect of a spatial harmonic beamformer design is the frequency dependency of the modes given by the spherical Bessel function (compare Equation (3)). This function is plotted in FIG. 2, where it can be seen that (i) the zero-order (n=0) mode is essentially flat over the lower frequencies and (ii) the higher-order modes have high-pass responses with order equal to the mode order. This response is similar to what was shown for spherical arrays by Meyer and Elko and is also well known for differential arrays. See, e.g., G. W. Elko, "Superdirectional Microphone Arrays," in *Audio Signal Processing for Next Generation Multimedia Communication Systems*, Editors: Yiteng (Arden) Huang and Jacob Benesty, Kluwer Academic Publishers, Boston (2004), the teachings of which are incorporated herein by references in its entirety.

Figure 2:
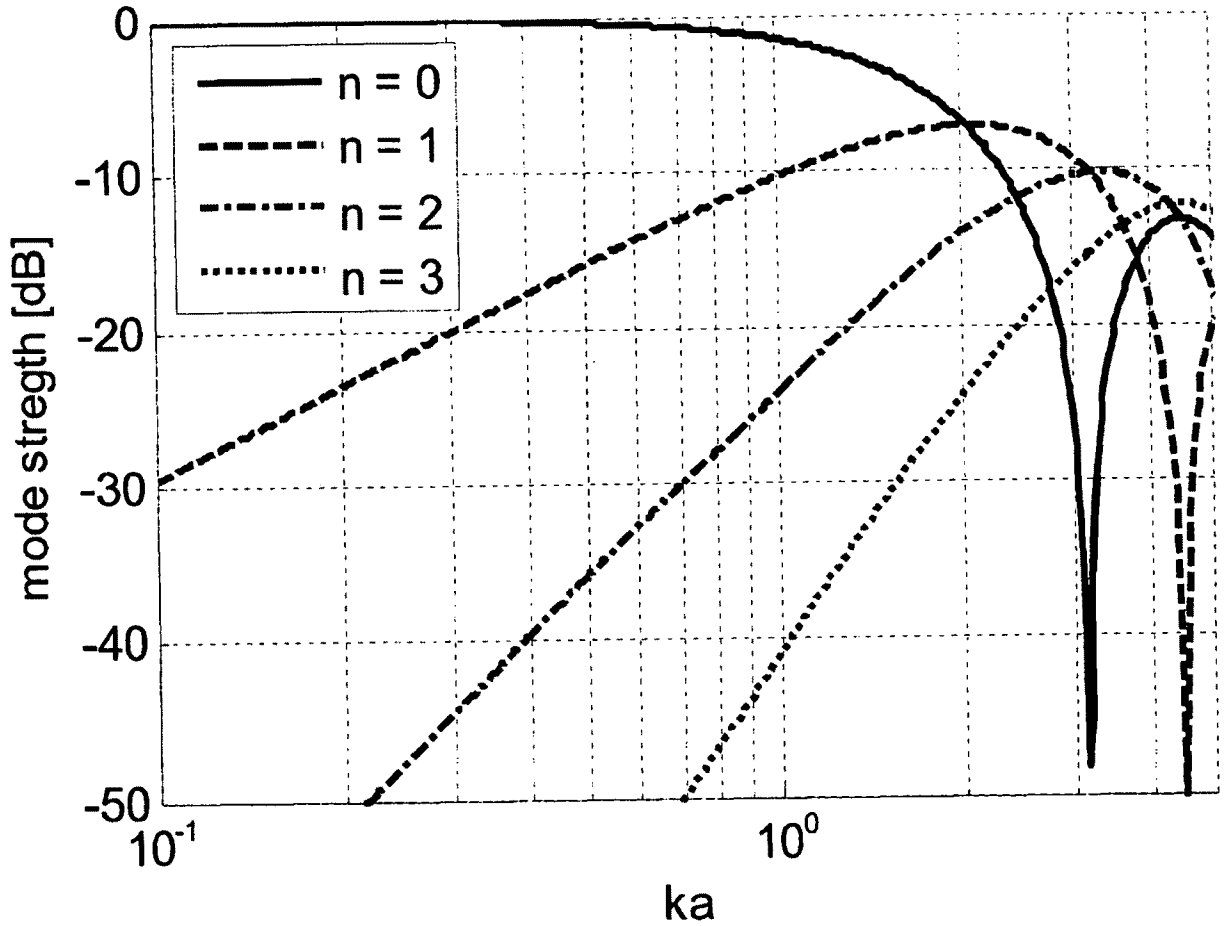
FIG. 2 shows a graphical representation of mode strengths for a continuous circular array.

Combining the modal aliasing results shown in FIG. 1 and the modal frequency responses shown in FIG. 2, one can observe two problems. First, modal aliasing, occurring initially with mode $Y_2^0$, contributes significantly to the fundamental mode $Y_0^0$ from ka=2 onwards. Second, due to singularities (zeroes) in the response, not all modes are available at all frequencies. Singularities in the modal response of the eigenbeams can have a serious impact on allowing a beamformer to attain a desired beampattern at the frequency of the singularity and at frequencies near this singularity. Thus, in order to enable the beamformer to utilize all of the degrees of freedom required to realize a general nth-order beampattern, the singularity problem should be eliminated.

Different ways to address this problem include the use of directional microphones (see, e.g., T. Rahim and D. E. N. Davies, "Effect of directional elements on the directional response of circular arrays," Proc. IEEE Pt H, Vol. 129 (1982), 18-22, the teachings of which are incorporated herein by reference in its entirety) and the placement of the microphones on the surface of a rigid baffle (see, e.g., Teutsch and Kellermann and J. Meyer, "Beamforming for a circular microphone array mounted on spherically shaped objects," J. Acoust. Soc. Am. 109, 185-193 (2001), the teachings of which are incorporated herein by reference in its entirety).

Both solutions have their own drawbacks. It is well known that directional microphones are typically less well-matched compared to omnidirectional microphones, which is important in array technology. Also, one has the undesired added complexity of accurately placing and adjusting the radial orientation of the elements, where great care must be given as to how both sides of the microphone are ported to the soundfield. Using a baffle can be visually obtrusive. Finally, and most importantly, both approaches do not solve the loss of beampattern control in the vertical direction for a circular array.

For a second-order beamforming array, both problems can be reduced by adding a single additional omnidirectional microphone at the center of a circular array. First, the occurrence of the first singularity can be avoided and, second, the aliased, $2^{nd}$-order harmonic can be extracted separately as shown in the next section. With these two problems addressed, the resulting second-order microphone array can be steered in the horizontal plane with at least some control over the vertical beampattern response, while extending the usable bandwidth of the beamformer.

Circular Array with Center Element

Using Equations (2) and (3), a single omnidirectional microphone, which can be used in the center of a circular microphone ring, has the spherical harmonic response $y_0(0, \theta,\phi)$ given by Equation (9) as follows:

$$y_0(0,\theta,\phi)=4\pi j_0(0)Y_0^0(\pi/2,0)Y_0^0(\theta,\phi) \tag{9}$$

Note that this result uses the fact that the spherical Bessel function $j_0$ for argument 0 is equal to zero for all orders larger than 0. The use of an additional center microphone in a circular microphone ring gives access to the "true" or non-aliased zero-order mode that can be used to reduce an aliased zero-order mode. In the frequency range from about ka=2 to about ka=4, the only significant components in the aliased mode $y_0$ from Equation (3) are the zero-order mode and the second-order mode. By combining the two outputs, one can isolate the second-order mode by adjusting the zero-order level, according to Equation (10) as follows:

$$\alpha_{y_0}(0, \vartheta, \varphi) - y_0(a, \vartheta, \varphi) = j_2(ka)Y_2^0(\pi/2, 0)Y_2^0(\vartheta, \varphi) \tag{10}$$
$$\Rightarrow \alpha = j_0(ka)$$

Thus, the addition of a single frequency-equalized (by $j_0(ka)$) microphone in the center of the circle to the output of the circular array of S sensors, allows one to extract the $Y_2^0$ mode, which is perpendicular to the array. Thus, one now has a way of controlling the vertical response of the array, since we now have access to the main vertical spherical harmonic mode that was aliasing into the zero-order cylindrical mode that was causing the detrimental loss in vertical beampattern response . Having access to the $Y_2^0$ vertical mode also effectively extends the usable frequency range for a second-order system by at least one octave. In summary, one now has full spatial response control over the second-order pattern steered in the horizontal plane. By using a beamformer geometry that allows access to all spatial modes, one can achieve the maximum directional gain for a second-order array, or equivalently, a Directivity Index (DI) of 9.5 dB. Directional gain refers to the increase in signal strength (e.g., in dB) of audio signals generated by a steered microphone array for an acoustic wave arriving from the steered direction relative to the audio signals that would be generated by an omnidirectional microphone for that same acoustic wave. Maximum second-order directional gain is achievable in the frequency range covered by the second-order pattern. Without access to all eigenbeams of all orders, a modal beamformer based only on the linear combination of the eigenbeams would not be able to achieve the maximum DI for a given array order. What is even worse is that, above ka=2, the second-order eigenmode dominates the m=0 mode and therefore can significantly increase the array sensitivity in the z-axis (i.e., vertical) direction.

The method described above can be extended to higher orders. As described in further detail below, for higher orders, one can use concentric rings of discrete microphone arrays instead of or in addition to a single sensor in the center. These additional concentric rings allow one to consecutively extract the vertical, previously aliased vertical spherical harmonic modes and thereby use these important modes in the overall 3D beamformer design (and not just the 2D response typical for a standard circular array). Without direct control of these out-of-plane spherical harmonics modes, one would lose control of the vertical beampattern response and significantly reduce the maximum attainable directional gain from the beamformer. One can even obtain beampattern responses where the vertical response of the beamfomer could be much larger than the response to the desired steered direction in the plane of the array.

Figure 3:
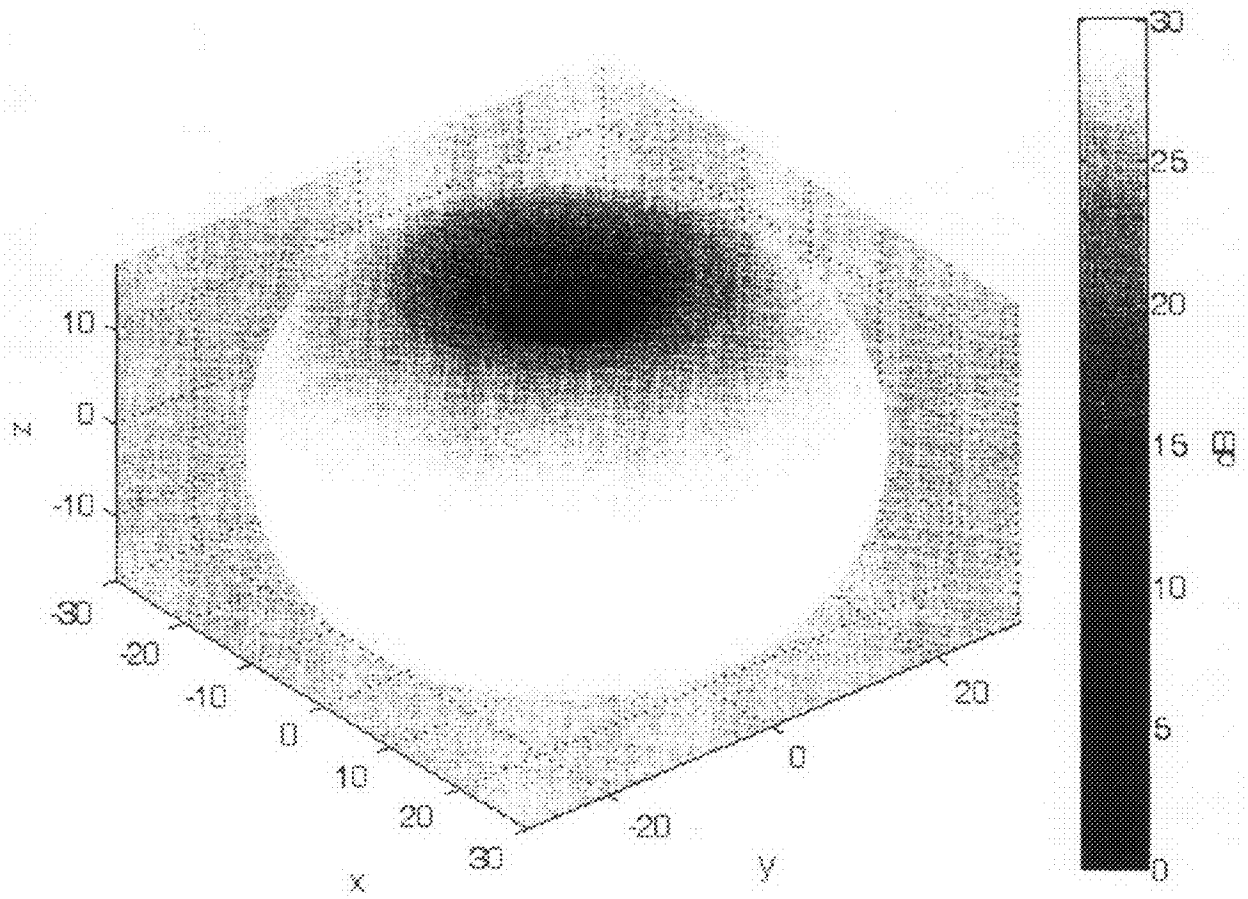
FIG. 3 shows a graphical representation of the beampattern of a second-order torus.

Implementing an equalization filter with a response for $j_0^{(ka)}$ for the approach according to Equation (10) can be costly. A reasonable compromise would be to use the center element to generate a horizontal second-order toroidal pattern with a zero facing towards the z-axis (normal to the plane of the circular array), such as that shown in FIG. 3. This pattern can be achieved by subtracting the properly scaled result given in Equation (3) (for m'=0) from Equation (9). The scaling is done such that the output of the difference is zero for a plane wave impinging from θ=0 (i.e., along the z-axis). For example, to attain a torus pattern for an array of S elements in the circle, each sensor can have a unity weight; in which case, the center element has to have a weight of −S. Since the integrated sensitivity of the ring is equal to the sensitivity of the center element, the output resulting from subtracting these two signals will force a zero in the vertical direction. Mathematically, this can be shown by computing the ratio of mode n=0, m=0 to mode n=2, m=0 as represented by Equation (11) as follows:

$$\frac{Y_0^0(\pi/2,0)(1-j_0(ka))}{Y_2^0(\pi/2,0)j_2(ka)} \approx \frac{Y_2^0(0,0)}{Y_0^0(0,0)} \tag{11}$$

This is the ratio for a second-order torus. Note that Equation (11) holds for a second-order approximation of the spherical Bessel functions. Eventually, the fourth-order term will become relevant and add the fourth-order pattern, which will change the beampattern in the vertical plane. (It is interesting to note here that the main vertical spherical modes that alias down to the lower-order modes are only even order.) However, the beampattern will always maintain a zero in the z-direction. The advantage from an implementation point of view comes at the expense of a slightly lower maximum DI. Fixing one zero at θ=0,180 limits the maximum DI to 9.4 dB compared to the maximum DI of 9.5 dB for a second-order array. It should be noted that fixing a null or minimum in the vertical direction limits the flexibility of control of the beampattern in the vertical direction.

Another interpretation of this solution is as follows. Instead of decomposing to have all spherical harmonics that have contributions in the horizontal plane (i.e., $Y_0^0$, $Y_1^{-1}$, $Y_1^1$, $Y_2^{-2}$, $Y_2^0$, and $Y_2^2$), the harmonics $Y_0^0$ and $Y_2^0$ are used in a fixed ratio, such as that presented in Equation (11) for forming a torus. This limits the flexibility in beampattern control in the vertical direction (one zero is fixed at 0, 180), but simplifies the implementation (the combined beam is achieved by a weight and add, while the independent access involves a filtering by Bessel function $j_0$).

Figure 4:
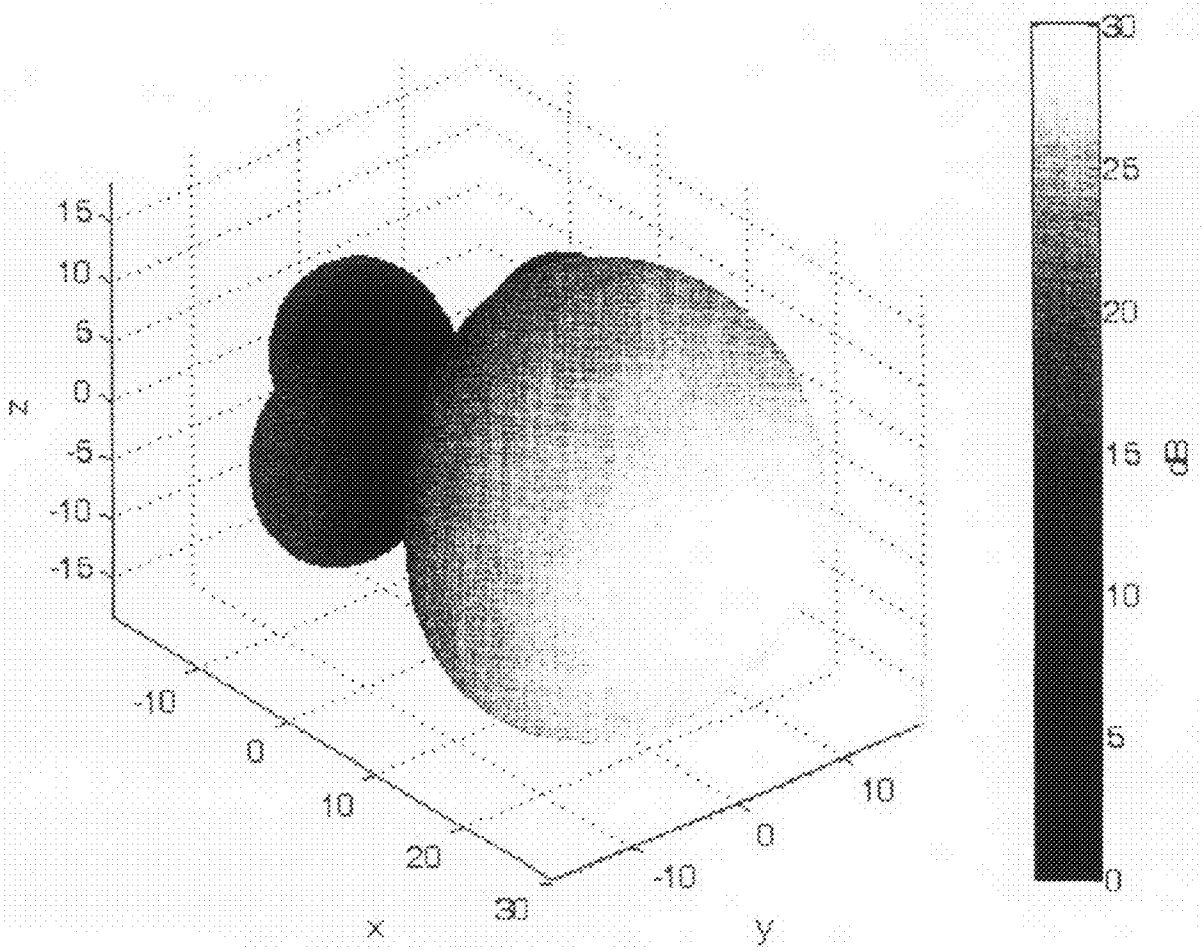
FIG. 4 shows a maximum DI (directivity index) $2^{nd}$-order beampattern using the torus of FIG. 3 and first-order and second-order eigenmodes.

The resulting pattern for maximum DI using the torus instead of the zero-degree modes directly is shown in FIG. 4. In particular, FIG. 4 shows a maximum DI $2^{nd}$-order beampattern using the torus of FIG. 3 and first-order (n=1, m=±1) and second-order (n=2, m=±2) eigenmodes. The beamwidth in the vertical direction is slightly wider than in the horizontal direction.

Figure 5:
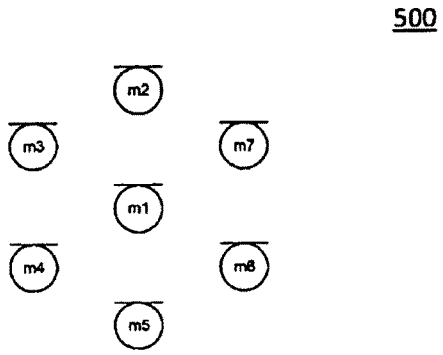
FIG. 5 shows a seven-element microphone array according to one embodiment of the present invention.

FIG. 5 shows a seven-element microphone array 500 comprising six microphones m2-m7 arranged in a circular portion of the array and one microphone m1 at the center of the circular portion, where all seven elements are co-planar.

As used in this specification, an array of microphones lying substantially in a horizontal plane is said to be "co-planar" if the vertical displacement of the array is less than the average horizontal distance between adjacent microphones within the array.

Figure 6:
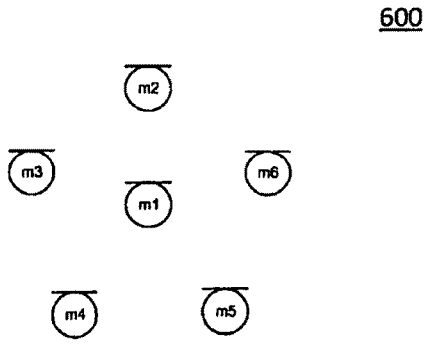
FIG. 6 shows a six-element microphone array according to another embodiment of the present invention.

FIG. 6 shows a six-element microphone array 600 comprising five microphones m2-m6 arranged in a circular portion and one microphone m1 at the center of the circular portion, where all six elements are co-planar. The six elements of microphone array 600 correspond to the fewest number of elements that can be used to realize a general two-dimensional steerable second-order array without losing control of the vertical response of the beampattern.

In the embodiments of FIGS. 5 and 6, the center microphone ml is an omnidirectional microphone, while the other microphones are either omnidirectional microphones or directional microphones, such as cardioid microphones. In alternative embodiments, the center microphone can be other than a single omnidirectional microphone. For example, the center microphone could be a dipole whose axis is normal to the elliptical array, where a reflecting plane makes a $\cos^2$ pattern (max in the vertical plane) to gain access to the vertical mode. As another example, the center microphone could be implemented using two vertical omnis located at the center of the elliptical array.

Audio System

Figure 7:
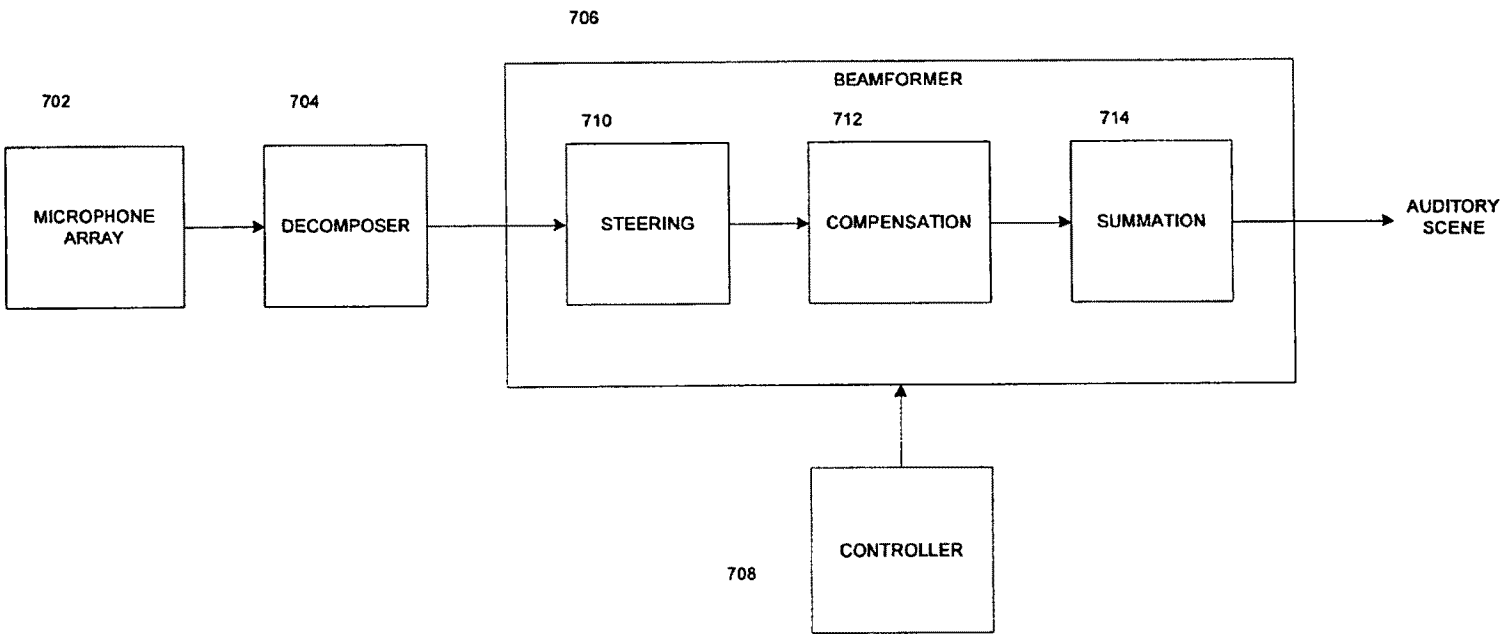
FIG. 7 shows an audio system according to one embodiment of the present invention.

FIG. 7 shows a block diagram of an audio system 700, according to one embodiment of the present invention. Audio system 700 includes microphone array 702, decomposer 704, modal beamformer 706, and controller 708, where modal beamformer 706 includes steering unit 710, compensation unit 712, and summation unit 714. Depending on the particular implementation, microphone array 702 may be implemented using microphone array 500 of FIG. 5, microphone array 600 of FIG. 6, or any other suitable microphone array in accordance with the present invention.

Decomposer 704 receives the audio signals generated by the individual microphones in microphone array 702 and spatially decomposes those signals to generate a plurality of eigenbeam outputs. In particular, decomposer 704 uses microphone elements on the circular portion as well as additional concentric circular portions or an additional single center microphone to allow the decomposition of cylindrical eigenbeams and the aliased vertical spherical modes so that all modes are accessible to the beamformer.

In one possible implementation of audio system 700 in which microphone array 702 has (i) a second-order circular portion having at least five sensors and (ii) a single center sensor, as in FIGS. 5 and 6, decomposer 704 spatially decomposes the audio signals corresponding to the sensors in the circular portion to generate five eigenbeam outputs $\hat{y}_{-2}$, $\hat{y}_{-1}$, $\hat{y}_0$, $\hat{y}_{+1}$ and $\hat{y}_{+2}$, according to Equation (6). Decomposer 704 then modifies one or more of these five eigenbeam outputs based on the audio signal from the single center sensor to generate a modified set of five eigenbeam outputs that is applied to beamformer 706. In particular, decomposer 704 subtracts individually filtered versions of the center audio signal from one or more of the different eigenbeam outputs to generate the modified set of eigenbeam outputs.

In one particular implementation, decomposer 704 subtracts a weighted version of the center audio signal from just the eigenbeam output $\hat{y}_0$ to generate the second-order toroidal output described previously in the context of Equation (11). This second-order toroidal output is applied to beamformer 706 in place or or in addition to the eigenbeam output $\hat{y}_0$ along with the other four unmodified eigenbeam outputs $\hat{y}_{-2}$, $\hat{y}_{-1}$, and $\hat{y}_{+1}$, and $\hat{y}_{+2}$.

As described previously in the context of Equation (10), decomposer 704 can process the eigenbeam outputs to extract the second-order $Y_2^0$ mode, which can be applied to beamformer 706.

Beamformer 706 receives and processes the modified set of eigenbeam outputs generated by decomposer 704 to generate an output auditory scene. In particular, steering unit 710 enables steering of the output auditory scene to any direction in the horizontal plane, while also using the decomposed vertical modes to control the vertical response of the beamformer. Steering is achieved by multiplying the eigenbeam output of degree m with the corresponding complex exponential $e^{-im\phi_0}$. where $\phi_0$ represents the steering angle within the horizontal plane. The decomposed vertical spatial modes do not have ϕ dependence, so these modes are not modified by steering unit 710.

Compensation unit 712 performs frequency-response compensation on the eigenbeams generated by steering unit 710 to equalize the responses of the eigenbeams extracted via Equation (6) as well as the separately decomposed vertical spatial modes. The eigenbeams have a frequency response described by the Bessel function of order n. In order to flatten the response, the beams are filtered by the inverse response before combining eigenbeams of different order to make their frequency responses equal.

Summation unit 714 multiplies each frequency-compensated, steered eigenbeam output generated by compensation unit 712 by a corresponding weight value to form a set of weighted eigenbeams. Summation unit 714 sums these weighted eigenbeams to generate a steered output beampattern as the auditory scene generated by audio system 700.

In Equation (7), the steering of eigenbeam output $\hat{y}_{m'}$ by steering unit 710 is embodied in the term $e^{-im\Phi_0}$, the frequency-response compensation of eigenbeam output $\hat{y}_{m'}$ by compensation unit 712 is embodied in the term $c_{m'}(ka)$, the weighting of eigenbeam output $\hat{y}_{m'}$ by summation unit 714 is embodied in the term $a_{m'}$, and the summation of eigenbeam outputs by summation unit 714 to generate the steered beampattern $d(\phi-\phi_0)$ is embodied in the summation operation $\Sigma$.

Controller 708 controls the operations of beamformer 706 by providing the steering angle $\phi_0$ for steering unit 710 and the weight values $a_{m'}$ for summation unit 714.

Note that, although all theory is presented in terms of complex exponentials, the system can be implemented with only real values by substituting the complex exponentials by cosine and sine representations.

Although FIG. 7 shows steering unit 710, compensation unit 712, and summation unit 714 being implemented in a particular sequence, since the steering, compensation, and weighting operations of Equation (7) are all linear operations, they can be performed in any order. In particular, since, in theory, beamformer 706 can simultaneously generate two or more differently steered beampatterns (e.g., six different beampatterns corresponding to 5.1 surround sound), it may be preferable to implement the compensation of compensation unit 712 once prior to the multiple different steerings of steering unit 710 for the different beampatterns.

Beamformer 706 can be controlled to generate the output beampattern based soley on the second-order $Y_2^0$ mode. Since that mode is oriented normal to the plane defined by the circular array, microphone array 702 can be used to record audio signals arriving at the array substantially along the axis normal to the array's plane.

Measurements

Figure 8:
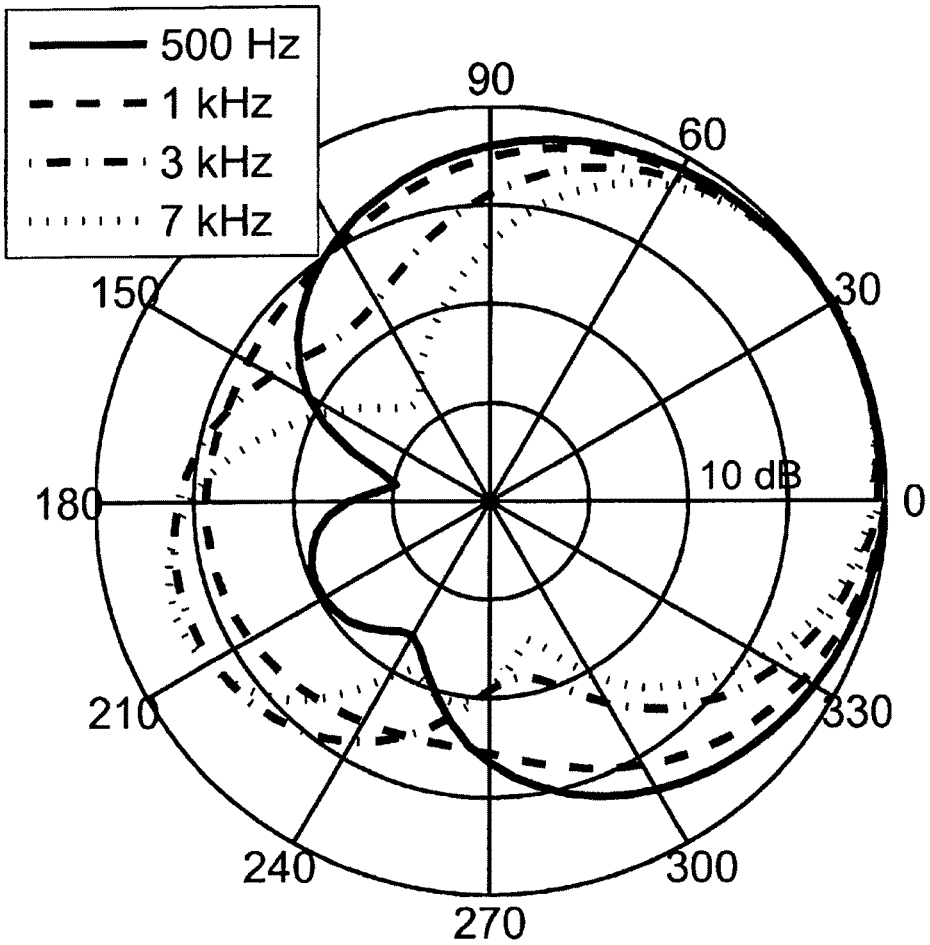
FIG. 8 shows a graphical representation of a measured steered beampattern for a seven-element array at frequencies from 500 Hz to 7 kHz.

FIG. 8 shows an actual measured beampattern for a particular implementation of seven-element array 500 of FIG. 5 steered to 30 degrees at a few frequencies (between 500 Hz and 7 kHz) at which the beamformer was designed to operate. In this implementation, the radius of the circular portion was 2.0 cm, and the seven microphones were all common, off-the-shelf, electret, omnidirectional microphones. The white noise gain (WNG) of the array was constrained to be greater than a value of −15 dB. As such, the array beampattern was constrained to first-order below 1 kHz, as can be seen in FIG. 8. It should be noted here that, in general, one may implement an nth order array such that, in order to control the WNG of the beamformer, the order of the array is reduced as the input sound-wave frequency is lower. Thus, one can design a beamformer that uses different orders in different frequency ranges where an example of this is shown in FIG. 8, where the second-order array is diminished to first-order below 1 kHz. The cutoff frequency settings for the different-order beamformers are a function of the ratio of the acoustic wavelength to the size of the array. As the wasvelength-to-size ratio becomes large, the order is lowered so that the desired beamformer minimum WNG is met. Frequency-dependent control of the beampattern can be implemented by using frequency-dependent weights in the beamformer summation unit. The concentric rings in the directivity plot of FIG. 8 are in 10-dB increments. The beampattern at 1 kHz is a combination of first-order and second-order, since this frequency is at the crossover from first-order to second-order due to the WNG constraint. FIG. 8 shows the response only in the plane of the array. Control over the vertical sensitivity of a circular array by adding a center microphone was verified by experimentally detecting the presence of a null or minima from this direction.

Conclusions

A wide-band steerable second-order microphone array has been presented along with an underlying efficient eigenbeamformer structure. It was shown by the use of a spherical harmonic expansion that higher-order modes can significantly limit the frequency range of operation of a circular array. Specifically, it was shown that one can control undesired vertical beampattern sensitivity due to modal aliasing of higher-order eigenmodes by adding microphones to a circular array. For the specific case of a second-order array, it was shown that placing a single extra microphone at the center of a circular array allows one to remove modal aliasing of higher-order modes and thereby extend the usable frequency range of the beamformer.

Broadening

Although the present invention has been described in the context of a co-planar, circular microphone array having a plurality of microphones arranged on a circular radial portion and a center microphone located substantially at the center of the circular radial portion, the invention is not so limited. In general, the radial portion of the array can have a substantially elliptical shape, where circles and ovals are particular types of ellipses.

Figure 9:
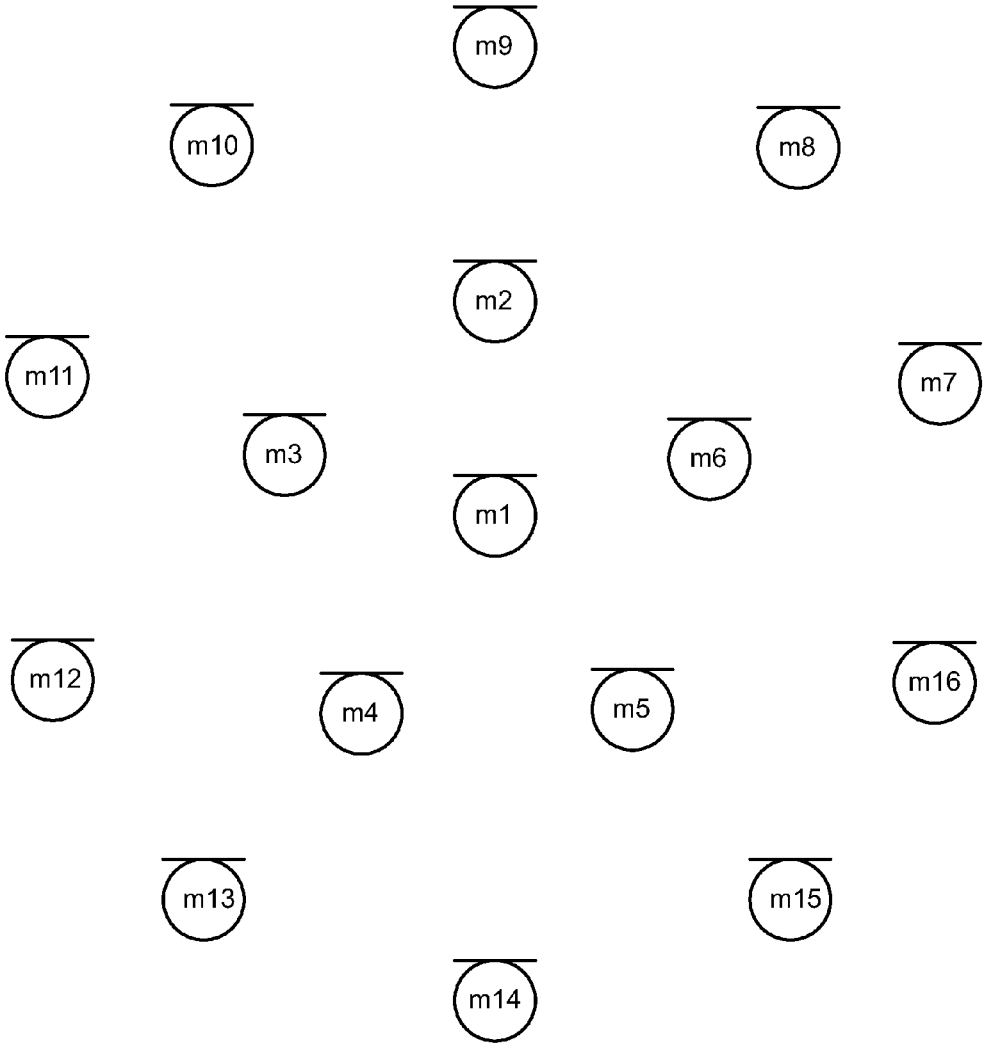
FIG. 9 shows a sixteen-element microphone array according to another embodiment of the present invention.

Furthermore, instead of a single radial portion with a center microphone, microphone arrays of the present invention can have two or more concentric radial portions with or without a center microphone, such as in FIG. 9. For example, a microphone array of the present invention can have two concentric elliptical radial portions, each radial portion having a plurality of microphones, where the inner elliptical radial portion functions analogously to the center microphones of the arrays of FIGS. 5 and 6. As used in this specification, two or more elliptical radial portions are said to be "concentric" if their centers substantially coincide. The arrays of FIGS. 5 and 6 may be said to have two concentric elliptical radial portions, where the inner elliptical radial portion has a single microphone element located on an ellipse having a radius of zero.

Although the present invention has been described in the context of second-order microphone arrays, the present invention can also be implemented in the context of higher-order microphone arrays. One way to achieve a higher-order microphone array is to increase the number of elements in the outer elliptical radial portion. In general, an nth-order elliptical microphone array has at least 2n+1 elements. Thus, an outer elliptical radial portion having at least 2n+1 elements can be used to implement an nth-order microphone array.

In order to provide a sufficient number of nulls or minima to maximize the control over the vertical response, an nth-order microphone array should be implemented using (i) n/2 concentric elliptical radial portions and a center element, for even values of n, and (ii) (n+1)/2 concentric portions with no center element for odd values of n, where each succeeding inner elliptical radial portion has enough elements to provide a two-degree lower order. For example, a $2^{nd}$-order microphone array with maximum vertical control would have a center element and one elliptical radial portions having at least 5 elements. Similarly, a $4^{th}$-order microphone array with maximum vertical control would have a center element and two concentric elliptical radial portions: (1) an outer, $4^{th}$- order elliptical radial portion having at least 9 elements and (2) an inner, $2^{nd}$-order elliptical radial portion having at least 5 elements. Furthermore, a $3^{rd}$-order array would have (1) an outer $3^{rd}$-order portion having at least 7 elements and (2) an inner $1^{st}$-order portion having at least 3 elements, and no center element.

Note that nth-order microphone arrays of the present invention can be implemented with fewer than n/2 concentric elliptical radial portions and/or without a center element, but at a loss of some vertical control.

Although the present invention is depicted in FIG. 7 as a real-time, co-located signal processing system, those skilled in the art will understand that any of the transmission paths between processing elements in FIG. 7 can be implemented with a storage device to represent the real-time storage and subsequent retrieval of data for further processing in a non-real-time manner. For example, the microphone signals generated by microphone array 702 and/or the eigenbeam outputs generated by decomposer 704 can be stored for subsequent retrieval and further processing. In addition, each transmission path between processing blocks in FIG. 7 can represent the transmission of data between remotely located processing elements.

The present invention may be implemented using (analog, digital, or a hybrid of both analog and digital) circuit-based processes, including possible implementation as a single integrated circuit (such as an ASIC or an FPGA), a multi-chip module, a single card, or a multi-card circuit pack. As would be apparent to one skilled in the art, various functions of circuit elements may also be implemented as processing blocks in a software program. Such software may be employed in, for example, a digital signal processor, microcontroller, or general-purpose computer.

The present invention can be embodied in the form of methods and apparatuses for practicing those methods. The present invention can also be embodied in the form of program code embodied in tangible media, such as magnetic recording media, optical recording media, solid state memory, floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

Unless explicitly stated otherwise, each numerical value and range should be interpreted as being approximate as if the word "about" or "approximately" preceded the value of the value or range.

It will be further understood that various changes in the details, materials, and arrangements of the parts which have been described and illustrated in order to explain the nature of this invention may be made by those skilled in the art without departing from the scope of the invention as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some, or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

We claim:

1. A signal processing subsystem for processing audio signals generated by a microphone array comprising (1) a first microphone set of two or more microphones located on a first ellipse and (2) a second microphone set of one or more microphones located within the first ellipse, wherein the microphones in the first and second microphone sets are effectively all in one plane, the signal processing subsystem comprising:

a decomposer adapted to spatially decompose the audio signals generated by the microphone array into a plurality of eigenbeam outputs, wherein the decomposer:

(i) generates a first set of beams using audio signals from the first microphone set, wherein the first set of beams provides beampattern control only within the one plane and no independent beampattern control out of the one plane;

(ii) generates second-set audio signals using audio signals from the second microphone set, wherein the second-set audio signals provide no independent beampattern control out of the one plane; and (iii) combines a filtered version of at least one of the beams and a filtered version of the second-set audio signals to generate at least one eigenbeam output, wherein the plurality of eigenbeam outputs provides beampattern control out of the one plane; and a beamformer adapted to combine the plurality of eigenbeam outputs to generate one or more output beampatterns.

2. The invention of claim 1, wherein the beams comprise at least one of cylindrical harmonics and spherical harmonics.

3. The invention of claim 1, wherein the signal processing subsystem further comprises a controller adapted to steer each output beampattern in a specified direction.

4. The invention of claim 1, wherein the beamformer generates each output beampattern by:

applying specified frequency dependent weight values to the plurality of eigenbeam outputs to generate a plurality of weighted eigenbeams; and summing the weighted eigenbeam outputs to form the output beampattern.

5. The invention of claim 1, wherein the second microphone set comprises a single microphone located at the center of the first ellipse.

6. The invention of claim 1, wherein the microphone array further comprises one or more additional microphone sets, each microphone set comprising a plurality of microphones and each microphone set concentrically located outside the first ellipse.

7. An audio system comprising the microphone array and the signal processing subsystem of claim 1.

8. The invention of claim 1, wherein the first set of beams and the plurality of eigenbeam outputs are eigenbeams.

9. The invention of claim 1, wherein the decomposer subtracts the filtered version of the second-set audio signals from a filtered version of a 0 th-order beam in the first set of beams to generate an eigenbeam output that provides at least some of the beampattern control out of the one plane.

10. A method comprising:

(a) receiving audio signals generated by a microphone array comprising (1) a first microphone set of two or more microphones located on a first ellipse and (2) a second microphone set of one or more microphones located within the first ellipse, wherein the plurality of microphones in the first and second microphone sets are effectively all in one plane;

(b) spatially decomposing the audio signals generated by the microphone array into a plurality of eigenbeam outputs, wherein, for zero-order mode, step (b) comprises:

(b1) generating a first set of beams using audio signals from the first microphone set, wherein the first set of beams provides beampattern control only within the one plane and no independent beampattern control out of the one plane;

(b2) generating second-set audio signals using audio signals from the second microphone set, wherein the second-set audio signals provide no independent beampattern control out of the one plane; and (b3) combining a filtered version of at least one of the beams and a filtered version of the second-set audio signals to generate at least one eigenbeam output, wherein the plurality of eigenbeam outputs provides beampattern control out of the one plane; and (c) combining the plurality of eigenbeam outputs to generate one or more output beampatterns.

11. The invention of claim 10, further comprising the step of generating the audio signals using the microphone array.

12. The invention of claim 10, wherein the second microphone set comprises a single microphone located at the center of the first ellipse.

13. The invention of claim 10, wherein the microphone array further comprises one or more additional microphone sets, each microphone set comprising a plurality of microphones and each microphone set concentrically located outside the first ellipse.

* * * * *